US005813244A

United States Patent [19]

Palmer

[11] Patent Number: 5,813,244

[45] Date of Patent: Sep. 29, 1998

[54] BIDIRECTIONAL FLOW CONTROL DEVICE

[75] Inventor: John M. Palmer, Cicero, N.Y.

[73] Assignee: Carrier Corporation, Syracuse, N.Y.

[21] Appl. No.: 912,729

[22] Filed: Aug. 18, 1997

Related U.S. Application Data

[63] Continuation-in-part of Ser. No. 758,131, Nov. 25, 1996, abandoned.

[51] Int. Cl.[6] ..... F25B 13/00

[52] U.S. Cl. ..... 62/324.6; 138/44; 62/511

[58] Field of Search ..... 62/324.6, 504, 62/511, 525; 138/44, 45

[56] References Cited

U.S. PATENT DOCUMENTS 4,653,291 3/1987 Moeller et al. ..... 138/44
5,341,656 8/1994 Rust, Jr. et al. ..... 62/324.6

*Primary Examiner*—John M. Sollecito

[57] ABSTRACT

A device for controlling or metering fluid flow in either direction through a conduit. The device comprises an elongated body having two end walls forming an internal chamber therebetween. One end wall of the device has a first metering orifice. The other end wall has one or more bypass openings. Disposed within the chamber is a free piston having a rod portion extending therefrom and disposed within the first metering orifice. The free piston and rod portion has a second metering orifice axially extending therethrough and in axial alignment with the first metering orifice. Fluid flow through the device urges piston against the end wall in the direction of fluid flow. In one position, fluid flowing into the device passes through the bypassing the opening(s) of the opposite end wall. Fluid flowing out of the device passes through the second metering orifice in the piston. Upon a flow reversal, the piston is urged against the opposite end wall. In this position, fluid flows through the metering orifice in the end wall then flows in serial fashion through the metering orifice in the piston. The device is adapted for use in a reversible vapor compression air conditioning system. In this application, the metering orifice in the end wall is sized to provide proper metering for heating mode operation. The metering orifice in the piston, in combination with the metering orifice in the end wall, is sized to provide proper metering for cooling mode operation.

4 Claims, 2 Drawing Sheets

BIDIRECTIONAL FLOW CONTROL DEVICE

This application is a continuation-in-part of prior application Ser. No. 08/758,131, filed Nov. 25, 1996, now abondoned, and names inventors named in the prior application.

BACKGROUND OF THE INVENTION

This invention relates generally to devices for controlling the flow of a fluid within a conduit. More particularly, the invention relates to a device that is capable of controlling the expansion of a fluid, such as a refrigerant for example, in either flow direction through the device. An application for such a device is in a reversible vapor compression air conditioning system, commonly known as a heat pump.

Reversible vapor compression air conditioning systems are well known in the art. A conventional heat pump system has a compressor, a flow reversing valve, an outside heat exchanger, an inside heat exchanger and one or more expansion means for metering flow, all connected in fluid communication in a closed refrigerant flow loop. The inside heat exchanger is located in the space to be conditioned by the system and the outside heat exchanger is located outside the space to be conditioned and usually out of doors. The flow reversing valve allows the discharge from the compressor to flow first to either the outside heat exchanger or the inside heat exchanger depending on the system operating mode. When the heat pump system is operating in the cooling mode, refrigerant flows first through the inside heat exchanger, which functions as a condenser and then through the outside heat exchanger, which functions as an evaporator. When the heat pump system is operating in the heating mode, the reversing valve is repositioned so that refrigerant flows first through the outside heat exchanger and the functions of the two heat exchangers are reversed as compared to cooling mode operation.

All vapor compression refrigeration or air conditioning systems require an expansion or metering device in which the pressure of the refrigerant is reduced. High pressure refrigerant in a supply line enters the metering device through a restrictive orifice wherein the flow rate is slowed and a lesser volume of refrigerant passes through the orifice. The refrigerant then expands to fill the volume in the supply line on the opposite side of the metering orifice. This process is interchangeably called metering, expanding or throttling. In nonreversing systems, the expansion device need only be capable of metering the flow in one direction. In heat pumps and other reversible systems, the refrigerant must be metered in both refrigerant flow directions. It is not satisfactory to use a single capillary tube or orifice in a reversible system, as the metering requirement during cooling mode operation is not equal to the requirement during heating mode operation. A simple capillary or orifice optimized for operation in one mode would give poor performance in the other mode. One known method of achieving the requirement for proper flow metering in both directions is to provide dual metering devices in the refrigerant flow loop between the two heat exchangers. The first metering device, a flow control device such as a capillary or orifice, is installed so that it can meter refrigerant flowing from the inside heat exchanger to the outside heat exchanger (cooling mode). The second metering device, which is similar to the first metering device but optimized for operation in the heating mode, is installed so that it can meter refrigerant flowing from the outside heat exchanger to the inside heat exchanger (heating mode). Check valves are installed in bypass lines around the metering devices and in such an alignment so that refrigerant flow can bypass the first metering device during cooling mode operation and bypass the second metering device during heating mode operation. This arrangement is satisfactory from an operational perspective but is relatively costly as four components are required to achieve the desired system flow characteristics.

It is known in the art to combine in one device the functions of metering in one flow direction and offering little or no restriction to flow in the other. Such a device is disclosed in U.S. Pat. No. 3,992,898. In such a system, two such devices are installed in series in the refrigerant flow loop between the heat exchangers. The first metering device allows free refrigerant flow from the inside heat exchanger to the outside heat exchanger and meters refrigerant flow in the opposite direction to provide optimum metering capacity during cooling mode operation. The second metering device allows free refrigerant flow from the outside heat exchanger to the inside heat exchanger and meters refrigerant flow in the opposite direction to provide optimum metering capacity during heating mode operation. U.S. Pat. No. 4,926,658 discloses the use of a two way flow control device in a reversible vapor compression air conditioning system. As disclosed therein, this flow control device meters the flow of refrigerant in both directions, however it relies on a separate check valve in combination with a conventional expansion valve to properly condition the fluid for the appropriate cycle.

SUMMARY OF THE INVENTION

The present invention is a flow control device that will properly meter fluid, such as refrigerant in its gaseous state as utilized in a reversible vapor compression system, flowing in either direction through the device. In particular, the device allows different metering characteristics for each direction.

The flow control device of the present invention includes a body having a first end wall, a second end wall, and a chamber formed therebetween. The first end wall having a bypass opening therethrough and communicating with the chamber which is coaxially formed within the body between the spaced apart walls. The second end wall having a metering orifice passing therethrough and communicating with the chamber which is coaxially formed within the body between the spaced apart walls. A free floating piston is slidably mounted within the chamber and adapted to move in response to and in the direction of flow passing through the chamber between the first and second end walls. The piston includes at least one metering orifice extending therethrough in such a manner as to come into axial alignment and communicate with the bypass opening in the first end wall and the metering orifice in the second end wall. When the piston is moved by fluid flow in a first direction against the second end wall fluid flows unrestricted through the bypass opening into the internal chamber through the metering orifice in the piston and then through the metering orifice in the second end wall whereby a metered quantity of fluid having reduced pressure exits the device. When the flow of fluid through the device is reversed, fluid first enters through the metering orifice in the second end wall, the piston is moved in the opposite direction and comes into contact with the first end wall, the fluid then flows through the at least one metering orifice in the piston and having reduced pressure exists the device through the bypass opening in the first end wall. The diameter and length of the metering orifices in each of the second end wall and the piston are sized to provide the proper metering of fluid flow in the respective direction of fluid flow. When the fluid flow is in the second direction the metering orifices act in series whereby the fluid flow is first restricted by the metering orifice in the second end wall then restricted by the metering orifice in the piston and expanded into the bypass opening and in the conduit. It should be evident to one skilled in the art that the effect of the metering orifices working in series is additive and therefore the device will provide different throttling of the refrigerant in each of the two fluid flow directions.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1:
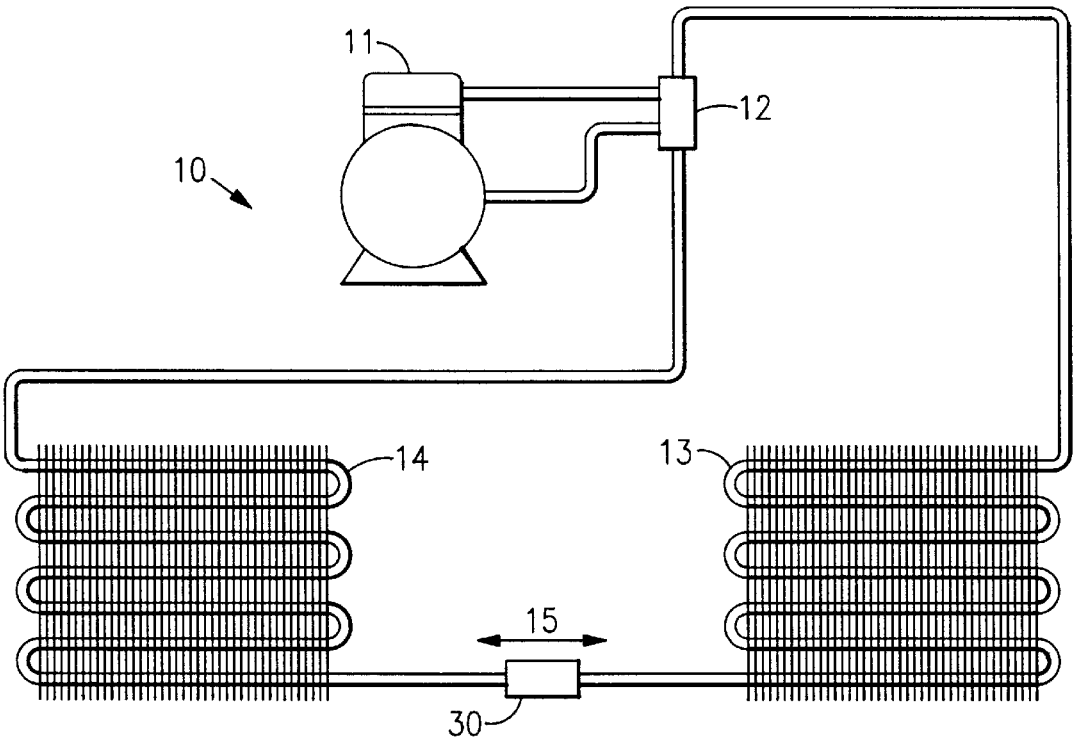
FIG. 1 is a schematic representation of a reversible vapor compression air conditioning system employing the flow control device of the present invention.

Referring to FIG. 1, there is illustrated a reversible vapor air conditioning system for providing either heating or cooling incorporating the bidirectional fluid control device 30 of the present invention. The system 10 basically includes compressor 11, fluid flow reversal valve 12, a first heat exchanger unit 13 and a second heat exchanger unit 14. In a heating mode of operation the fluid flow 15 is from left to right. As a result heat exchanger 14 functions as a conventional condenser within the cycle while heat exchanger 13 performs the duty of an evaporator. In the heating mode of operation the fluid, refrigerant, passing through the supply line is throttled from the high pressure condenser 14 into the low pressure evaporator 13 in order to complete the cycle. When the system is employed as a heat pump the direction of the refrigerant flow is reversed and the function of the heat exchangers is reversed by throttling refrigerant in the opposite direction. The flow control device of the present invention is uniquely suited to automatically respond to the change in refrigerant flow direction to provide the proper throttling of refrigerant in the required direction.

Figure 2:
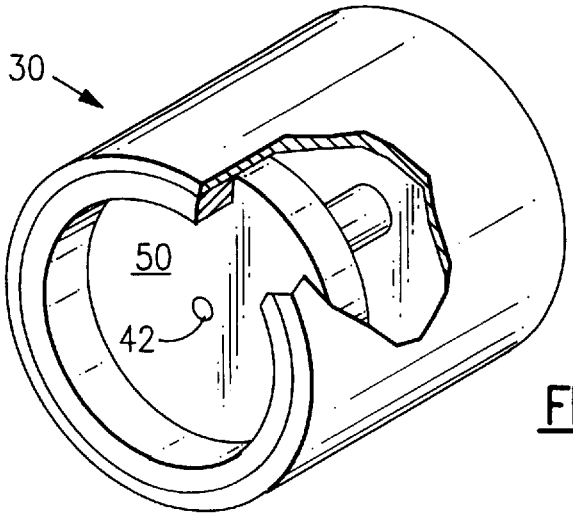
FIG. 2 is an isometric view in partial section of the flow control device of the present invention incorporated in the system illustrated in FIG. 1.
Figure 3:
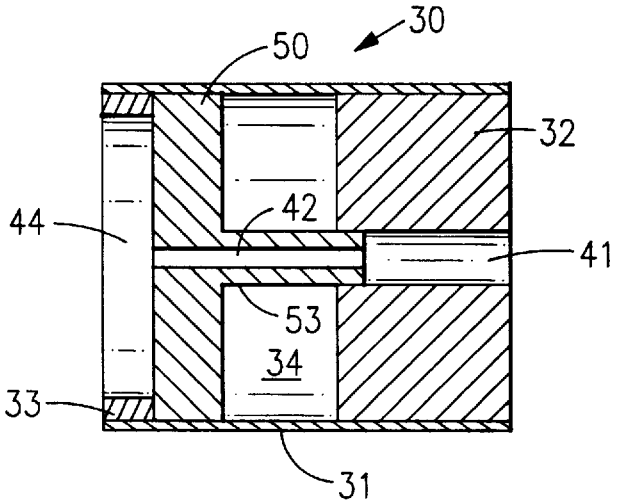
FIG. 3 is a plan view in section of the flow control device of the present invention incorporated in the system illustrated in FIG. 1.

Referring to FIG. 2 the bidirectional flow control device 30 of the present invention includes a free floating piston 50 having a metering orifice 42. Referring now to FIG. 3 the bidirectional flow control device of the present invention comprises a generally cylindrical body with end walls 32 and 33 closing off the body to form internal chamber 34. The end wall 32 has a metering orifice 41, centrally located and coaxially aligned with the body. The end wall 33 has a bypass opening 44 centrally located and coaxially aligned with the body.

The free floating piston 50 is coaxially disposed and slidably mounted within the internal chamber. The piston has a cylindrical body 51 and a rod portion 53 extending therefrom and having a metering orifice 42 centrally located extending through the body and the rod and axially aligned and in communication with metering orifice 41 and the bypass opening 44. The body of the foreshortened piston is sized diametrically such that in assembly is permitted to slide freely in the axial direction within the internal chamber and such clearance is provided to avoid a dash pot effect. Likewise the rod portion of the piston is sized diametrically such that in assembly is permitted to slide freely in the axial direction within metering orifice 41. The piston is provided with two flat and parallel end faces 54, 55. The left hand end face 54, as illustrated in FIG. 3, is adapted to arrest against end wall 33 of the internal chamber and the right hand end face 55 adapted to arrest against end wall 32. The metering orifice 42 is sized properly to meter refrigerant fluid flow when the system 10 is operating in the heating mode. Metering orifice 42, in series flow arrangement with metering orifice 41, is properly sized for the cooling mode.

In operation, the bidirectional flow control device 30, as shown in FIG. 1, controls the flow of refrigerant fluid flow between the heat exchangers 13, 14. When the system 10 is operating in the cooling mode the fluid flow 15 moves as indicated from heat exchanger 13 to heat exchanger 14. Under the influence of the flowing refrigerant, the piston is moved to the left (when viewing FIG. 1) against end wall 33. Refrigerant flows through metering orifice 41, and then through metering orifice 42. The flow of refrigerant mixes upon exiting the left hand face of the piston and expands as it exits the device through bypass opening 44 to throttle the refrigerant from the high pressure side of the system to the low pressure side. Similarly, when the system is operated in the heating mode the cycle is reversed, the refrigerant is caused to flow in the opposite direction, the piston is automatically moved to the right (when viewing FIG. 1) against end wall 32 whereby the refrigerant is properly metered through orifice 41.

Device 30 may be configured in several variations. It may be sized so that its outer diameter is slightly smaller than the inner diameter of the tube that connects heat exchangers 13 and 14. During manufacture of the system, device 30 is inserted into the tube and the tube is crimped near both end walls 32 and 33 so that the device cannot move within the tube. Alternatively, the device can be manufactured with threaded or braze fittings, not shown, at both ends so that it may be assembled into the connecting tube using standard joining techniques.

Figure 4:
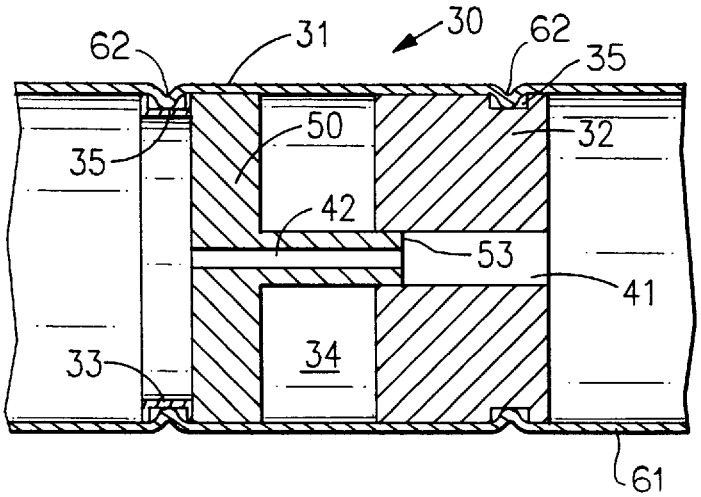
FIG. 4 is a plan view in section of another embodiment of the flow control device of the present invention.

Still another configuration is shown in FIG. 4. In that embodiment, tube 61 forms the cylindrical side wall of device 30. End walls 32 and 33, with free piston 50 between them, are inserted into tube 61. Each of end walls 32 and 33 has a circumferential notch around its periphery. With end walls 32 and 33 and piston 50 properly positioned with respect to each other, tube 61 is crimped. The crimping creates depressions 62 into notches 46 that prevent the end walls from moving within the tube.

What is claimed is:

1. A device for controlling the flow of a fluid in a conduit both a first and second direction comprising:

an elongated body having a first end wall and a second end wall defining an internal chamber therebetween;

the first end wall having at least one bypass opening axially extending therethrough and in communication with the internal chamber;

the second end wall having a first metering orifice axially extending therethrough;

a foreshortened piston disposed in the internal chamber and being slidably movable axially in response to fluid flow, the piston having a first end face parallel to the first end wall and a second end face parallel to the second end wall;

a rod portion extending from the second end face slidably disposed within the first metering orifice;

the piston and rod portion further having a second metering orifice extending therethrough and in axial alignment with the first metering orifice;

whereby the piston meters flow-through the second metering orifice in a first fluid flow direction and meters flow serially through the first orifice and thence the second orifice in a second fluid flow direction and permits the fluid to flow into the conduit.

2. The device as set forth in claim 1 wherein the first and second end walls are disposed within the conduit.

3. A reversible vapor compression air conditioning system having a compressor, a first heat exchanger and a second heat exchanger being selectively connected to the compressor, switching means for selectively connecting the inlet and discharge side of the compressor between the exchanger and a refrigerant supply line for delivering refrigerant from one exchanger to the other, comprising:

a flow control device mounted in the supply line between each exchanger having an elongated body having a first end wall and a second end wall defining an internal chamber therebetween;

the first end wall having at least one bypass opening axially extending therethrough and in communication with the internal chamber;

the second end wall having a first metering orifice axially extending therethrough;

a foreshortened piston disposed in the internal chamber and being slidably movable axially in response to fluid flow, the piston having a first end face parallel to the first end wall and a second end face parallel to the second end wall;

a rod portion extending from the second end face slidably disposed within the first metering orifice;

the piston and rod portion further having a second metering orifice extending therethrough and in axial alignment with the first metering orifice;

whereby the piston meters flow through the second metering orifice in a first fluid flow direction and meters flow serially through the first orifice and thence second orifice in a second fluid flow direction and permits the fluid to flow into the supply line.

4. A reversible vapor compression air conditioning system as set forth in claim 3 wherein the supply line comprises the elongated body.

* * * * *